US008511513B2

(12) United States Patent
Schultz

(10) Patent No.: US 8,511,513 B2
(45) Date of Patent: Aug. 20, 2013

(54) DISPENSING AND METERING SYSTEM

(75) Inventor: Carl L. Schultz, Plymouth, MI (US)

(73) Assignee: Nordson Corporation, Westlake, OH (US)

( * ) Notice: Subject to any disclaimer, the term of this patent is extended or adjusted under 35 U.S.C. 154(b) by 914 days.

(21) Appl. No.: 12/494,066

(22) Filed: Jun. 29, 2009

(65) Prior Publication Data

US 2009/0321475 A1 Dec. 31, 2009

Related U.S. Application Data

(60) Provisional application No. 61/076,528, filed on Jun. 27, 2008.

(51) Int. Cl.
*B67D 1/00* (2006.01)

(52) U.S. Cl.
USPC ..... 222/63; 222/52; 222/137; 222/276; 222/333; 222/504

(58) Field of Classification Search
USPC ..... 222/1, 5–276, 333, 504; 137/599.05, 137/599.16, 601.01
See application file for complete search history.

(56) References Cited

U.S. PATENT DOCUMENTS

| | | | | | |
|---|---|---|---|---|---|
| 3,292,824 | A * | 12/1966 | Arp et al. | 222/250 |
| 3,653,783 | A * | 4/1972 | Sauder | 417/298 |
| 4,136,708 | A * | 1/1979 | Cosentino et al. | 137/99 |
| 4,826,046 | A * | 5/1989 | Rudick | 222/129.3 |
| 4,863,358 | A * | 9/1989 | Lindner | 417/500 |
| 5,110,267 | A * | 5/1992 | Giordani | 417/404 |
| 5,524,797 | A * | 6/1996 | Schultz, Sr. | 222/334 |
| 5,564,912 | A * | 10/1996 | Peck et al. | 417/396 |
| 5,819,983 | A * | 10/1998 | White et al. | 222/1 |
| 5,992,696 | A * | 11/1999 | Schultz et al. | 222/146.2 |
| 6,450,369 | B1 * | 9/2002 | Heyes | 222/129.1 |
| 6,550,643 | B1 * | 4/2003 | Foster et al. | 222/63 |
| 6,840,404 | B1 * | 1/2005 | Schultz et al. | 222/61 |
| 7,074,020 | B2 * | 7/2006 | Navarro | 417/454 |
| 2005/0072800 | A1 * | 4/2005 | Smith | 222/129.2 |

* cited by examiner

*Primary Examiner* — Frederick C Nicolas
(74) *Attorney, Agent, or Firm* — Wood, Herron & Evans, L.L.P.

(57) ABSTRACT

A dispensing system includes a first chamber and a second chamber, where each chamber includes an inlet port configured to receive a flowable material and an outlet port configured to dispense the flowable material. The system also includes a first displacement rod slidably disposed in the first chamber. The system also includes a second displacement rod slidably disposed in the second chamber, wherein the first displacement rod is rigidly connected to the second displacement rod.

14 Claims, 7 Drawing Sheets

DISPENSING AND METERING SYSTEM

RELATED APPLICATION

This application claims priority to U.S. Provisional Application No. 61/076,528 filed on Jun. 27, 2008, the contents of which are incorporated herein in its entirety.

BACKGROUND INFORMATION

Metering and dispensing systems are generally used to provide a measured flow of flowable material from a material reservoir to a particular application. Materials can include fluids, such as sealants, adhesives, epoxies, and the like. Metering and dispensing devices ensure that a specified amount of material is delivered to the application each time the material is required. For example, many operations in the manufacture of an automobile require an application of precisely metered materials, such as the application of sealants to an automobile's body structure. Metering and dispensing devices can be used to eliminate the guesswork, human error, and waste associated with having to apply a precise amount of material.

Such systems are commonly used to provide a uniform continuous flow, and also to provide a single application of a specific amount of material, often referred to as a metered shot of material. Metering and dispensing devices are commonly used to dispense sealants, adhesives, epoxies, and the like, including two-part materials. For example, a metering and dispensing system may dispense a two-part epoxy, where the system mixes a resin with a catalyst just before applying the two-part epoxy to an application. In such an application, it is often important to prevent weak spots, where the mixture is light on either the catalyst or the resin. To prevent such weak spots, metering and dispensing systems must ensure that both the catalyst and the resin are provided evenly and continuously.

DETAILED DESCRIPTION

Metering and dispensing devices are typically designed around the concept of a piston and cylinder. The piston is often connected to a connecting rod that moves the piston back and forth throughout the length of the cylinder. The connecting rod is then connected to a driveshaft or drive rod that is operated by a motor or actuator. In metering and dispensing devices, when the piston reaches a specified location in the cylinder, material is allowed to fill through a cylinder inlet. When the cylinder has been filled, the piston is pushed by the connecting rod into the cylinder, which in turn, forces material out of a cylinder outlet. The amount of material dispensed during each cycle is equal to the volume of the cylinder as the piston contacts the interior walls of the cylinder. Thus, changing the amount of material dispensed in a single stroke of the piston requires either changing the cylinder height or the piston/cylinder diameter. Either approach is inconvenient and time-consuming. Further, when dispensing abrasive materials, the cylinder walls and the outer surface of a piston can be damaged by the abrasive material as the outer surface of the piston contacts the cylinder walls.

As illustrated below, a metering and dispensing system can also utilize a displacement rod configuration, instead of a piston. A displacement rod, unlike a piston, is characterized by leaving a gap between the displacement rod and a cylinder wall. A displacement rod can be any size or shape, regardless of the size of the cylinder, and is configured to displace material, instead of attempting to push out the entire contents of the cylinder. Thus, the amount of material provided by the metering and dispensing system is determined by the volume displaced by the displacement rod as it travels within a cylinder. Such a configuration allows a metering and dispensing system to be easily and inexpensively re-configured for different applications simply by changing the size of the displacement rod. Further, the amount of material dispensed can be controlled by altering the distance of the upstroke and the downstroke. Further, as discussed below, a dispensing system can be configured as a double-action system having two dispensing chambers, each having a displacement rod rigidly connected together and controlled by a single motor or actuator. Such a double-action system can dispense material on both an upstroke and a downstroke because the system can re-load material into one dispensing chamber while the other chamber is dispensing material. As a result, the dispensing speed is twice that of a single-action system, with no need to stop dispensing in order to reload material.

Figure 1:
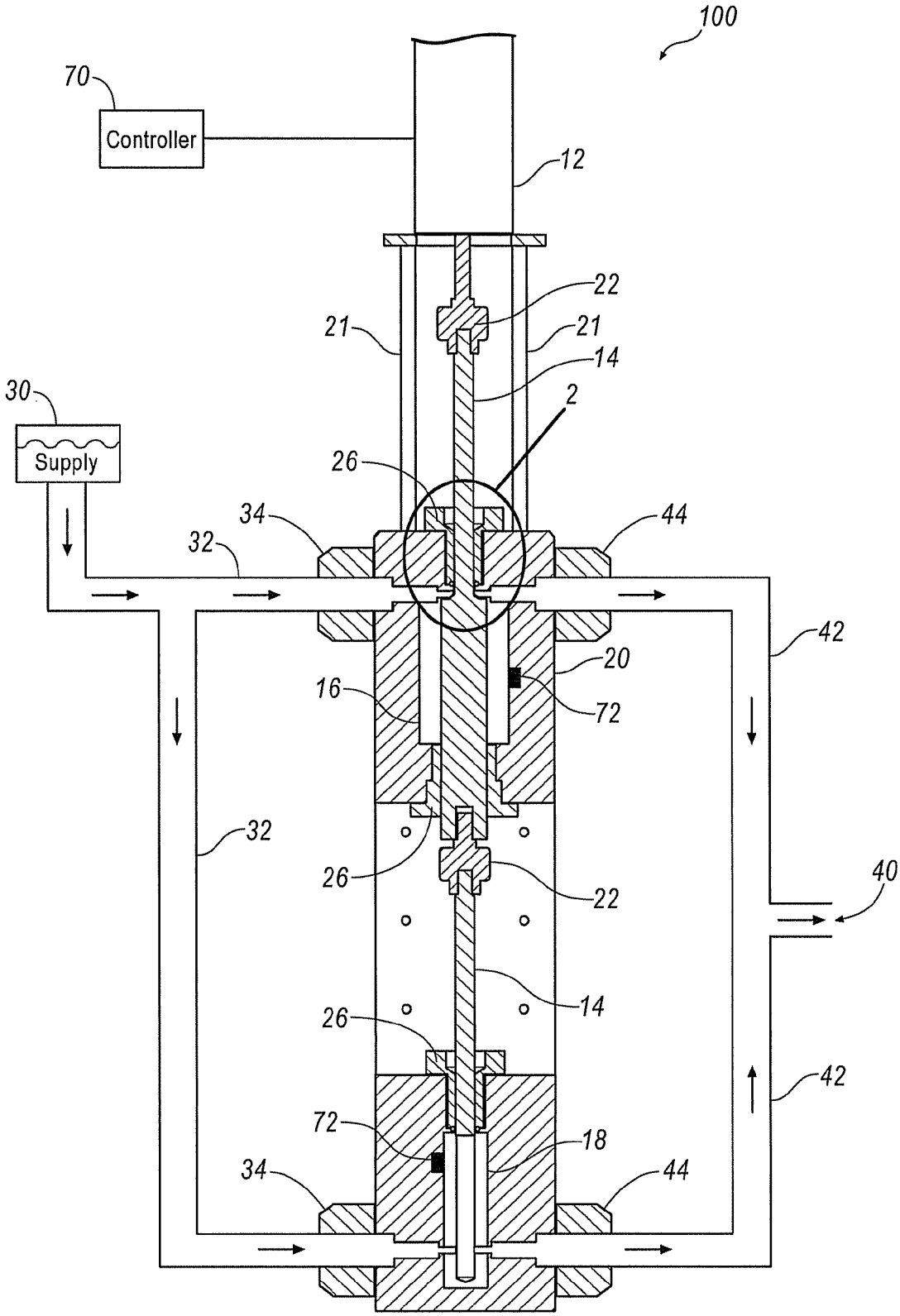
FIG. 1 illustrates an exemplary double-action metering and dispensing system.

FIG. 1 illustrates an exemplary double-action metering and dispensing system 100. System 100 includes a motor 12 that drives a rod 14 through one or more chambers 16, 18. Typically, system 100 also includes seals 26 that create an interference fit around rod 14 and ensure a fluid-tight seal to prevent material leakage or air intake into chambers 16, 18. Generally, system 100 includes a frame 20 that provides a mounting platform for the various parts and accessories. For example, as shown in FIG. 1, motor 12 may be mounted to frame 20 by supports 21. System 100 also includes a material supply 30, which can be a storage container, such as a fluid drum. Typically, one or more fluid pumps are used in connection supply 30 to transport material through supply lines 32. Supply 30 is fluidly connected to chambers 16, 18 through supply lines 32. Further, chambers 16, 18 are also fluidly connected to an outlet 40 through output lines 42. Supply lines 32 are connected to input ports 34 on chambers 16, 18, and output lines 42 are connected to output ports 44 on chambers 16, 18. Input and output ports 34, 44 may be check valves, or powered ports controlled by a controller 70.

System 100 is a double-action dispensing system that is capable of providing continuous flow to outlet 40 while rod 14 moves through an upstroke and through a downstroke. As previously discussed, system 100 is configured to dispense material from one chamber while re-loading material into the other chamber. As shown in FIG. 1, rod 14 is in a raised position and prepared to move downward during a downstroke (when viewed with motor 12 on top and chamber 18 on the bottom). During the downstroke, material is provided to outlet 40 from chamber 18, while chamber 16 is refilled with material from supply 30. As rod 14 begins moving downward for a downstroke, input port 34 of chamber 16 is open to allow material to flow from supply 30 into chamber 16, and output port 44 of chamber 16 is closed. Further, output port 44 of chamber 18 is open, thereby allowing material held within chamber 18 to flow through output lines 42 to outlet 40. Conversely, during the subsequent upstroke, material is provided to outlet 40 from chamber 16, while chamber 18 is refilled with material from supply 30. As such, during an upstroke, input port 34 of chamber 16 and output port 44 of chamber 18 are closed, while input port 34 of chamber 18 and output port 44 of chamber 16 are open.

Input and output ports 34, 44 are typically two-way valves, where each has an "open" state and a "closed" state. Input and output ports 34, 44 can be controlled by controller 70, which may also control motor 12. Controller 70 can be any type of electronic controller that is capable of providing operational control signals to electronically-controlled components. Typically, controller 70 includes a processor, a memory, and one or more computer-readable mediums for storing computer-executable instructions. Further, controller 70 also typically includes numerous communication ports such that controller 70 can be communicatively coupled to one or more devices, including input and output ports 34, 44, and motor 12.

Controller 70 may also receive feedback or data from one or more sensors. For example, chambers 16, 18 may include pressure sensors 72 that are configured to monitor the internal pressure within each chamber. Further, controller 70 may monitor the speed and force of motor 12. For example, motor 12 may be a line actuator, such as a GSX series line actuator made by Exlar Corporation of Minnesota that can provide speed and force feedback to controller 70. Controller 70 may be configured in a feedback system to alter various aspects of system 100 based on one or more sensor readings. Of course, system 100 may include any number and configuration of sensors and controllers, including multiple controllers operating independently of one another, or two or more may be communicatively coupled together and configured to manage one or more devices. Further, rod 14 may be actuated by a pump or some other mechanism that operates independent of a controller.

Figure 2:
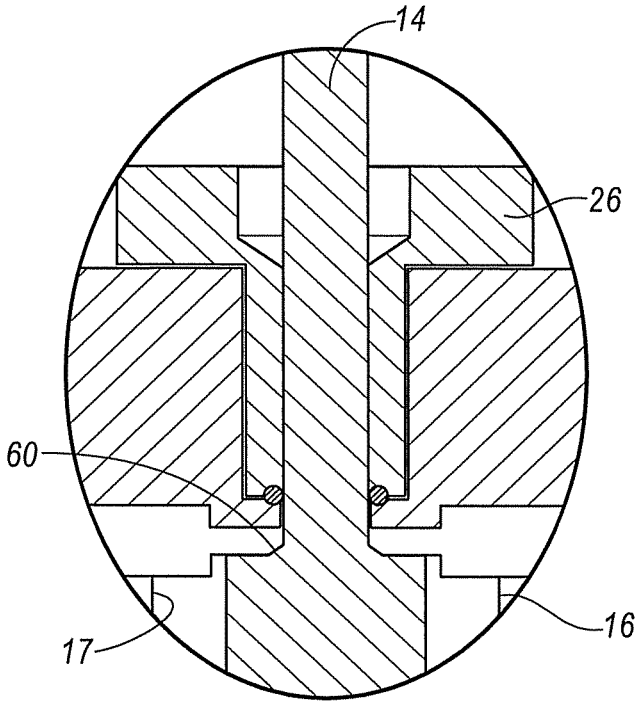
FIG. 2 is a close-up view of a seal and a displacement rod.

Rod 14 can be configured as a piston in a cylinder, where the diameter of the rod closely approximates the diameter of the cylinder. Rod 14 can also be configured as a displacement rod—where the amount of material dispensed is based on the volume that is displaced by a portion of the displacement rod. As shown in FIG. 1, rod 14 can include multiple individual sections that are connected to one another through rod connectors 22. Further, rod 14 may include a step 60, which is further illustrated in FIG. 2. A step 60 in rod 14, as shown in FIG. 2, includes a first diameter that is larger than a second diameter. By providing a stepped rod 14, one motor 12 acting on one linked rod 14 can be used to provide a double-action dispensing system, actuating two or more chambers simultaneously, such as chambers 16 and 18.

System 100, as illustrated in FIGS. 1 and 2, can be configured to provide uniform material dispensing in both an upstroke and a downstroke by ensuring that a proper relationship exists such that the volume of material dispensed in each chamber 16, 18 is uniform. In brief, uniform dispensing can be assured by ensuring that the amount of material displaced by rod 14 in each chamber 16, 18 is the same. Because rod 14 can include multiple, individual sections for each chamber, the size of the chambers 16, 18 can be arbitrary, as well as the size of the sections of rod 14. Because rod 14 will move up and down uniformly in both chambers 16, 18, meaning that rod 14's relative height in both chambers will remain equal, ensuring uniform dispensing can be easily maintained by ensuring that the volume displaced by rod 14 in each chamber is equal. However, as discussed in more detail below, it may be desirable to dispense different amounts of material during an upstroke and a downstroke. Therefore, the size of chambers 16, 18, as well as the size of various sections of rod 14 may vary depending on a particular application. Further, controller 70 may also vary the speed with which rod 14 moves through chambers 16, 18, and thereby alter the rate that the material flows to outlet 40.

Figure 3:
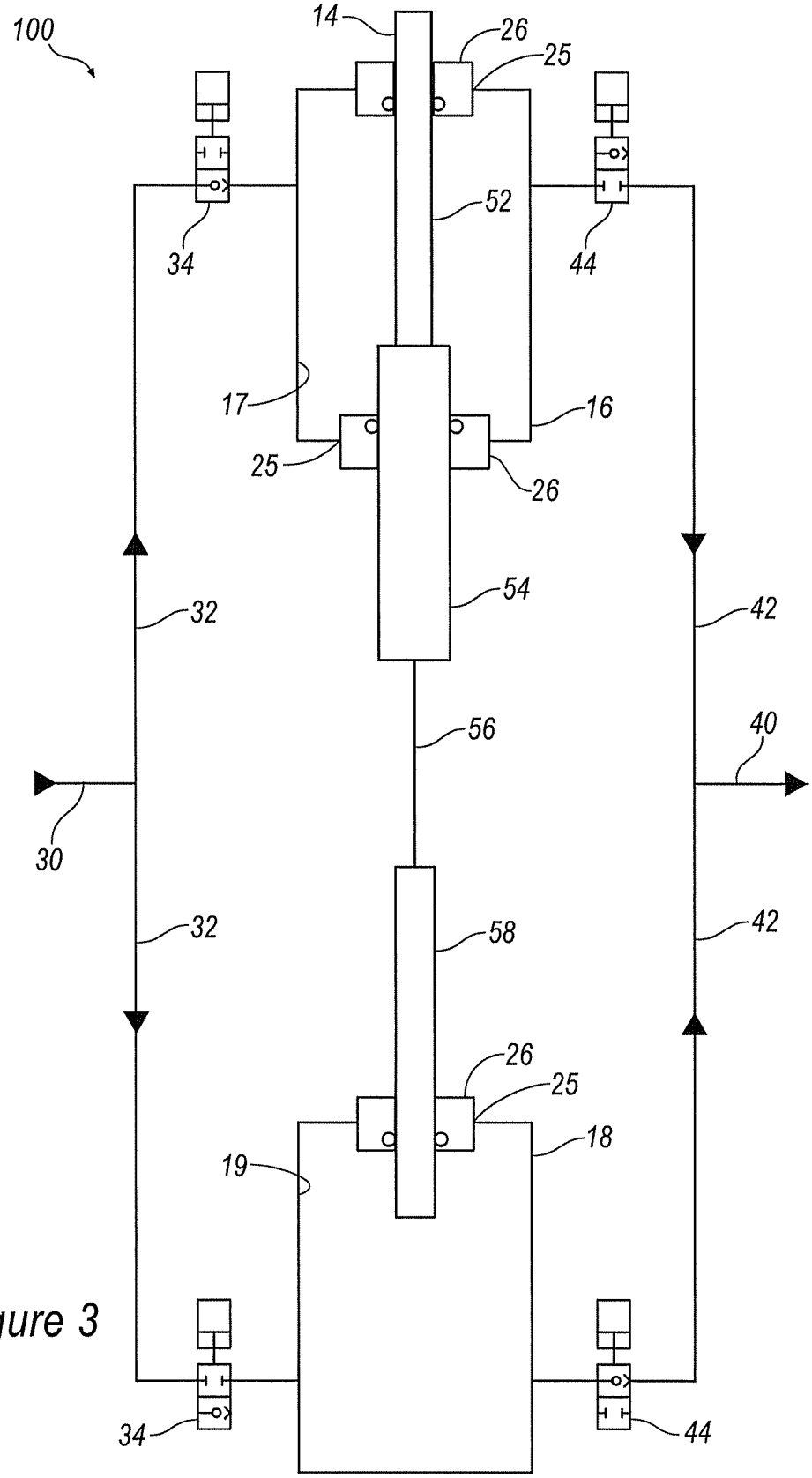
FIG. 3 is a schematic diagram of an exemplary double-action metering and dispensing system.

FIG. 3 is a schematic diagram of system 100. As shown in FIG. 3, system 100 includes chambers 16, 18, where each is in fluid communication with a material supply 30 via input ports 34. Chambers 16, 18 also dispense material through output ports 44 to an outlet 40. As illustrated in FIG. 3, displacement rod 14 includes multiple individual sections. While rod 14 may be a single, unified construction, rod 14 can also be comprised of individual rod sections that are rigidly secured to one another. Such rod sections can be coupled together with fasteners, connectors, threaded connections, welded together, etc. As shown, rod 14 includes a drive rod section 52 that is slidably disposed within chamber 16 and rigidly connects a first displacement rod section 54 to a motor or actuator (not shown). First displacement rod section 54 is then rigidly secured to a second displacement rod section 58 via a connecting rod section 56. Second displacement rod section 58 is slidably disposed within chamber 18. As further illustrated in FIG. 3, rod 14, as a displacement rod, is characterized by having a cross-sectional area maintains a gap or fluid passageway between rod 14 and interior walls of chambers 16, 18. As shown, drive rod section 52 and first displacement rod section 54 are both slidably disposed within chamber 16. Chamber 16 includes a gap or fluid passageway between rod sections 52, 54 and an interior wall 17. Further, chamber 18 also includes an interior wall 19, and a gap is maintained between second displacement rod section 58 and wall 19 in chamber 18.

To balance system 100, and to thereby dispense an equal amount of material out of chambers 16, 18, the volume displaced by the various rod sections within each chamber 16, 18 should be approximately equal. As shown in FIG. 3, first displacement rod section 54 has a greater cross-sectional area than second displacement rod section 58. Such a configuration allows the system to be balanced as it compensates for the volume of drive rod 52. Thus, the difference between the cross-sectional area of drive rod 52 and first displacement rod section 54 is approximately equal to the cross sectional area of second displacement rod 58. Since the various sections are rigidly secured to one another, rod 14 moves together, thus the relative distance traveled within each chamber 16, 18 remains constant. Thus, the volume displaced in each is based upon the cross-sectional area of the various sections. For example, the volume displaced in chamber 18 is based on the cross-sectional area of second displacement rod section 58, while the volume displaced by chamber 16 is based on the difference in cross-sectional areas between drive rod section 52 and first displacement rod section 54. Of course, the various rod sections of rod 14 could be configured in numerous different configurations. For example, system 100 can be configured to provide different amounts of material during an upstroke and a downstroke, for example, by using differently sized rod sections.

As illustrated in FIGS. 1-3, seals 26 can be removable to allow for differently sized sections of rod 14. For example, chamber 16 can have fixed upper and lower apertures 25 that each receives a removable seal 26. Seal 26 can be a rubber gasket, plug, or other type of seal that provides a fluid-tight interference fit between chamber 16 and rod 14. Using removable seals 26 allows system 100 to use differently sized rods 14 or rod sections. Therefore, system 100 can be easily and inexpensively modified to provide different amounts of material without expensive tooling or design changes. For example, chamber 16 can have a fixed volume with a relatively large aperture 25, but can be configured to provide relatively little material during operation by using a small displacement rod, such as a rod that only displaces roughly 10% of the volume of chamber 16. Thus, by using removable seals 26 and interchangeable rod sections, system 100 can be easily changed for different applications, including applications that require different amounts of dispensed material during an upstroke and a downstroke. Removable seals 26 can include an outer diameter that is configured to create an interference fit in aperture 25 of chamber 16, and an interior orifice that is configured to create an interference fit with a particular displacement rod of a particular size. As shown in FIG. 1, chambers 16 and 18 both include removable seals 26 at their respective openings or apertures.

Rod 14 can include multiple connectors 22, including connectors on either side of chambers 16, 18, thereby allowing system 100 to use interchangeable displacement rod sections. Therefore, the amount of material displaced can be quickly and easily modified by swapping one sized displacement rod section for another. Each section can be configured to displace a pre-determined amount of material out of its respective chamber. In a piston configuration, the diameter of the piston approaches the diameter of the cylinder and therefore dispenses the majority of the volume of the cylinder. In a displacement rod configuration, however, the displacement rod has a cross-sectional area that is typically substantially less than the cross-sectional area of the chamber. The amount of material dispensed is then based on the volume within the chamber that is displaced by the rod. For example, a displacement rod may be cylindrical, and therefore the volume displaced by the displacement rod can be calculated based on the rod's radius and the distance that the rod travels within the chamber. For example, the volume displaced by a displacement rod equals $\pi*r^2*h$, where r is the radius of the displacement rod and h is the distance that the rod travels within the chamber. Of course, rod 14 and chambers 16, 18 can be of any shape and are not necessarily cylindrical. As rod 14 is configured to maintain a gap between interior walls of chambers 16, 18 and rod 14, the cross-sectional shape of the various components, including rod 14 and chambers 16, 18, are arbitrary and to not need to match one another.

Figure 4:
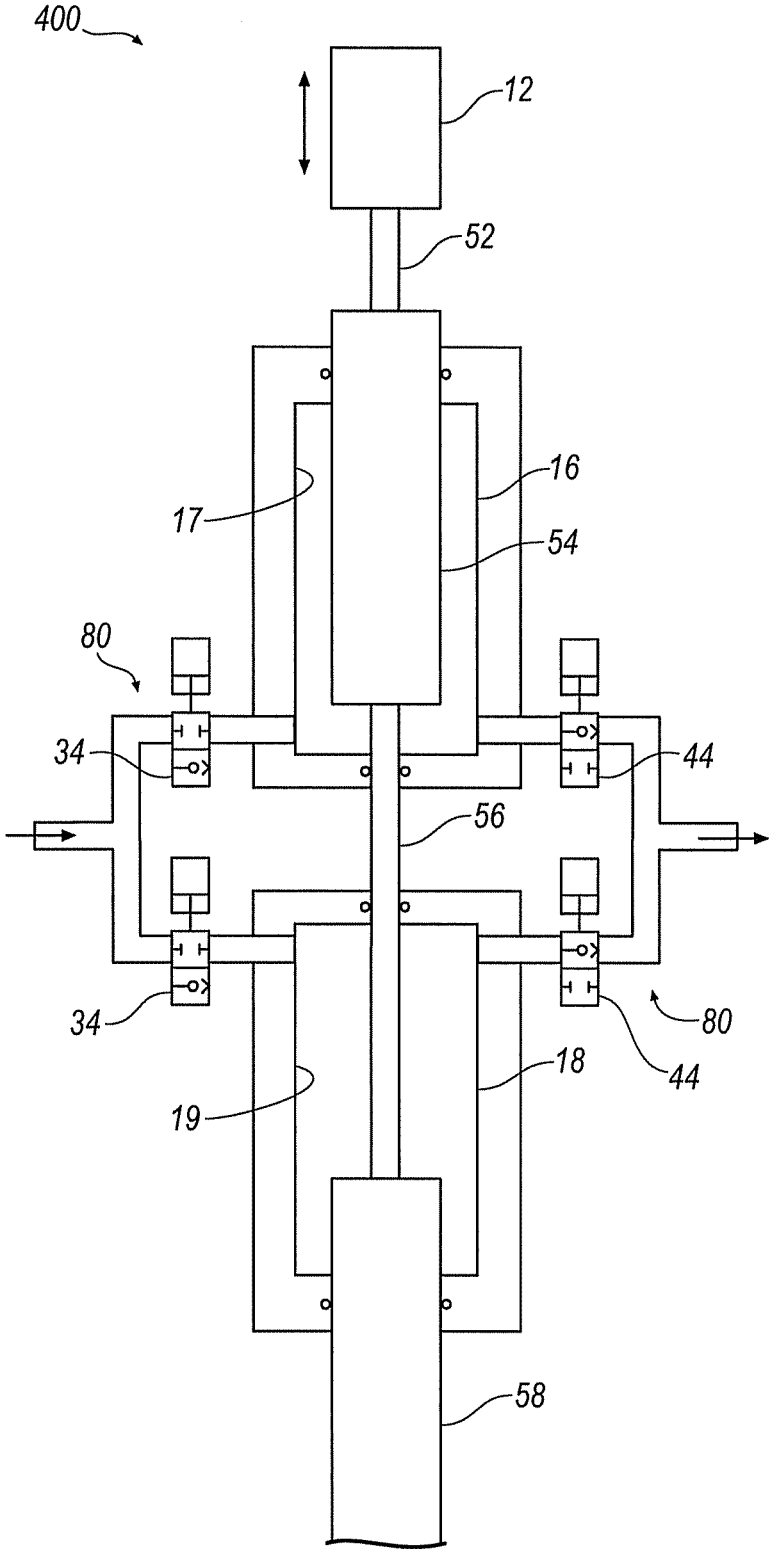
FIG. 4 illustrates yet another exemplary double-action metering and dispensing system.

FIG. 4 illustrates an exemplary system 400 that includes mixing circuits 80 coupled to the inlet ports 34 and the outlet ports 44. Also, as illustrated in FIG. 4, rod 14 includes multiple individual sections slidably disposed in each chamber 16, 18. As illustrated in FIG. 4, rod 14 includes first and second displacement rod sections 54, 58, which are rigidly connected to one another via a connecting rod 56. Further, first displacement rod section 54 is rigidly connected to motor 12 via drive rod 52. However, FIG. 4 illustrates a balanced system where first and second displacement rod sections 54, 58 have approximately equal cross-sectional areas. FIG. 3 illustrates a balanced system where first displacement rod section 54 has a larger cross-sectional area than second displacement rod section 58 in order to compensate for the drive rod 52. However, in FIG. 4, both chambers 16, 18 receive connecting rod 56 and drive rod 52 does not enter into chamber 16. Thus, there is no need to compensate for drive rod 52, and therefore system 400 can be balanced by having first and second displacement rod sections 54, 58 that have approximately equal cross-sectional areas. Each section of rod 14 is configured with a cross-sectional area that maintains a gap or fluid passageway between rod 14 and interior walls 17, 19 of chambers 16, 18. System 400 as illustrated in FIG. 4 includes one additional aperture in chamber 18, however, as compared to system 100 as illustrated in FIG. 3.

Figure 5:
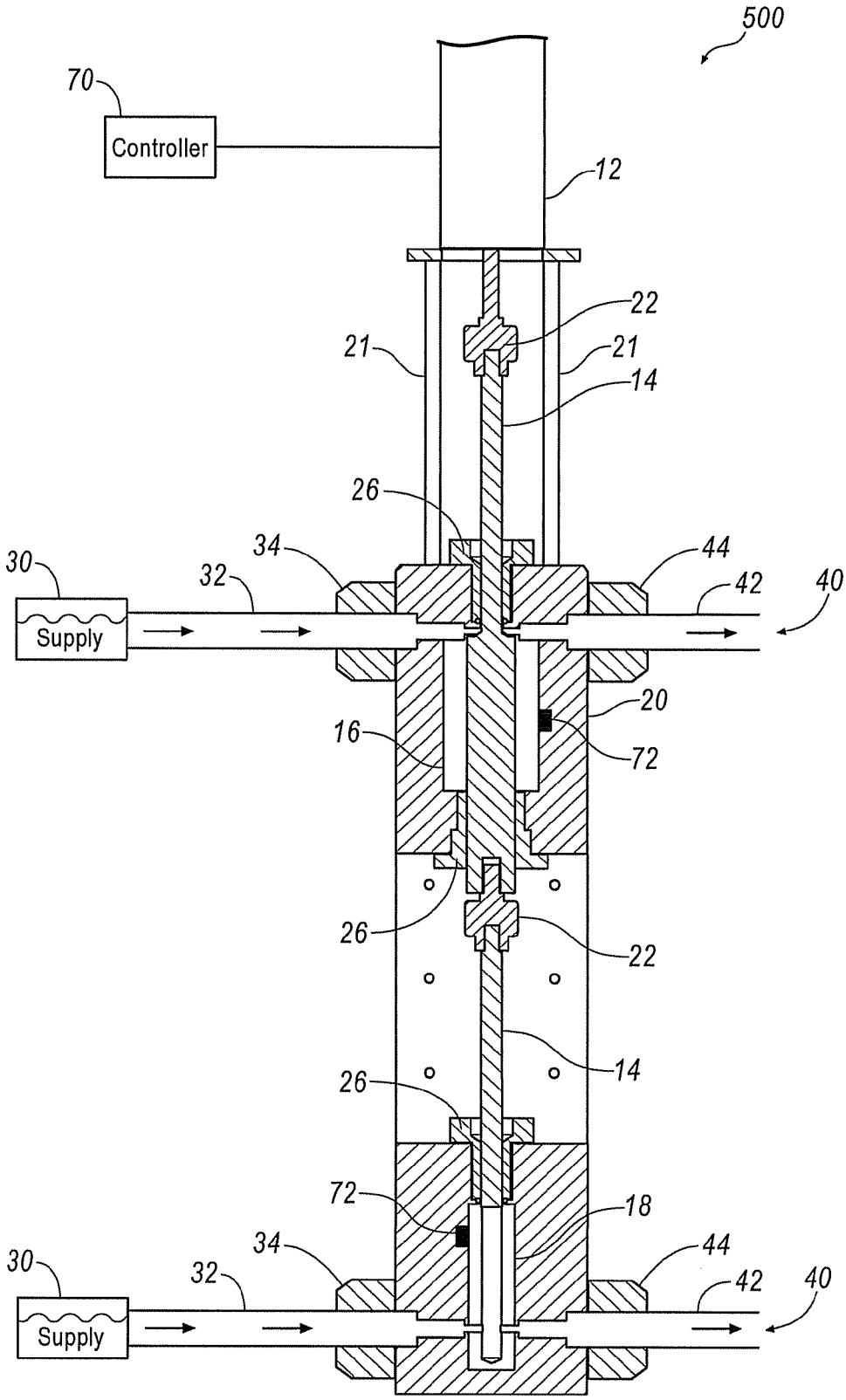
FIG. 5 illustrates an exemplary double-action metering and dispensing system utilizing two material supplies.

FIG. 5 illustrates an exemplary double-action metering and dispensing system 500 that utilizes two material supplies 30, and is thus capable of dispensing two different materials. However, as illustrated in FIG. 5, system 500 could provide one material on an upstroke and the second material on a downstroke.

Figure 6:
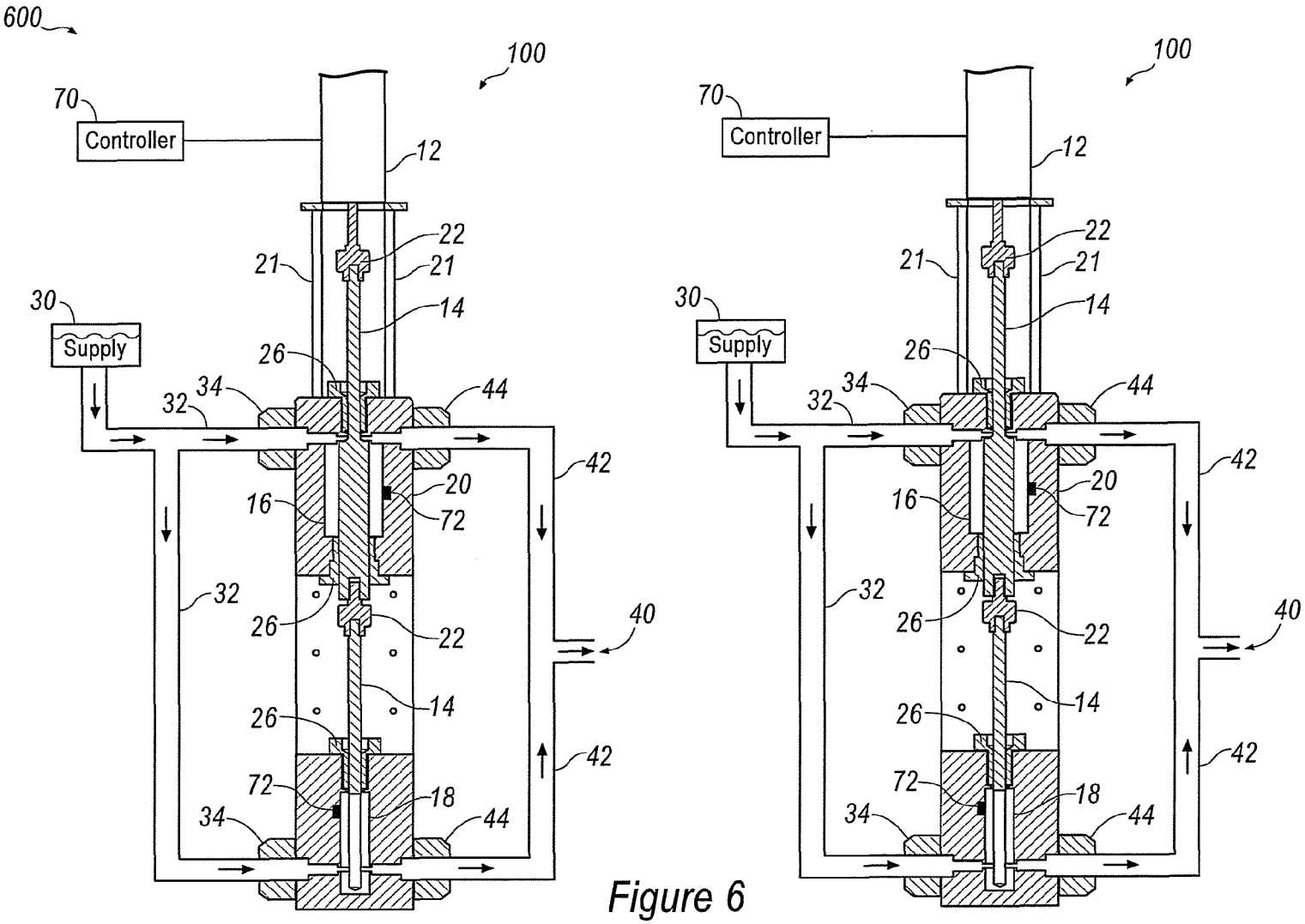
FIG. 6 illustrates yet another exemplary double-action metering and dispensing system utilizing two material supplies.

FIG. 6 illustrates a dual-rod double-action system 600 that includes two double-action dispensing systems 10, such as that illustrated in FIG. 1. System 600 is capable of providing continuous flow of two different materials. System 600 includes two motors 12, where each motor controls a double-action dispensing system 100. System 600 can utilize dual independent servo drives and motors with absolute encoder feedback. Using independent motors (i.e. servo drives, linear actuators, etc.) to dispense and control each material component allows for electronically variable ratio for mixed material dispensing. System 600 is capable of providing blended multi-segment preset shots, with each segment having its own volume, flow rate and ratio. System 600 can be further configured to dispense each material at one of multiple preset flow rates. Further, system 600 can be configured to dispense each material at a variable flow rate determined by interlocks from customer automation. System 600 can include various sensors to monitor variables such as the position of each rod, the speed of each motor, and the current draw for each material. Further, such sensors can be connected to one or more controllers 70, and track and graph the volume of material dispensed for each part as well as a total for mixed material. Further, system 600 may be configured to compare the volume dispensed to preset limits. In addition, system 600 can be configured to track and graph a ratio of mixed material dispensed, and compare that ratio to a preset limit.

Similar to system 100, system 600 may also include pressure sensors 72 in each chamber 16, 18. System 600 may also be configured to independently pre-pressurize each material to ensure identical initial conditions for the start of each dispense cycle despite variations in material supply pressures. In addition, system 600 can be configured to independently de-pressurize each metering chamber. Further, system 600 can be configured to monitor material pressures and compare those pressures to preset limits for high pressure, low dispense pressure, reload pressure, pre-pressure, and de-pressure. Further, system 600 can be configured to track and graph material pressures during dispense cycle, and record and display minimum and maximum material pressures.

Figure 7:
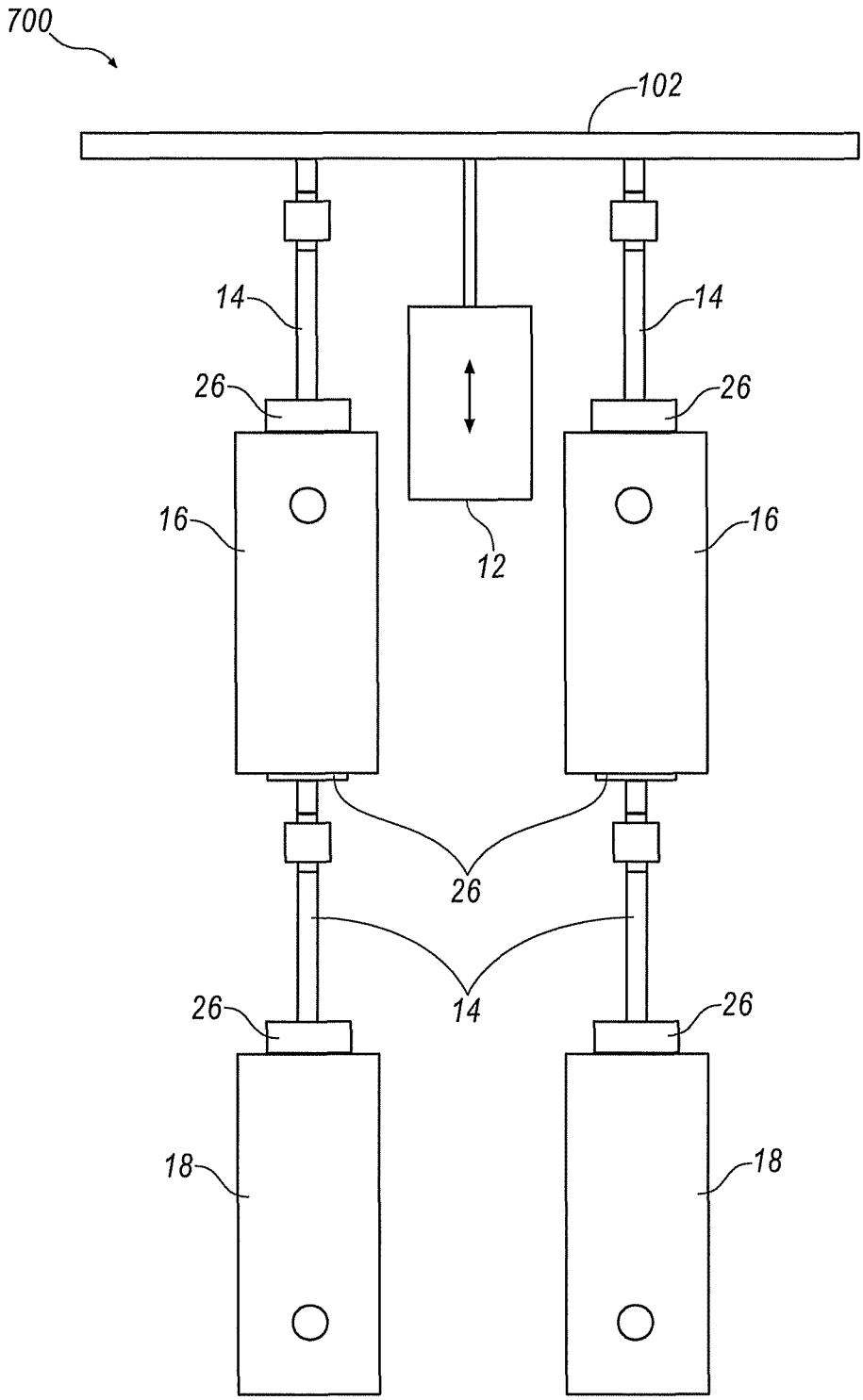
FIG. 7 illustrates yet another exemplary double-action metering and dispensing system.

FIG. 7 illustrates an exemplary system 700, which is also a dual-rod double-action system, similar to system 600. However, system 700 utilizes only one motor 12 to control all chambers (i.e. both rods 14) simultaneously. As illustrated in FIG. 7, motor 12 actuates a connecting bar 102 that in turn actuates rods 14. Such a configuration can provide tandem metering for each material driven by a common servo drive and motor. Such a configuration can also provide the benefit of rod metering while eliminating delay between multiple sequential shots due to reload. The foregoing description of features are not limited to any particular system, but can be implemented in any of the described dispensing systems.

Accordingly, it is to be understood that the above description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems, methods, and devices will be incorporated into such future embodiments. In sum, it should be understood that the invention is capable of modification and variation.

All terms used in the claims are intended to be given their broadest reasonable constructions and their ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

The invention claimed is:

1. A dispensing system, comprising:

first and second chambers, each having an inlet port configured to allow flowable material to pass into said chamber and an outlet port configured to allow said flowable material to pass out of said chamber;

a first displacement rod slidably disposed in said first chamber, said first displacement rod having a displacement volume that is smaller than a total volume of said first chamber;

a second displacement rod slidably disposed in the second chamber and configured to operate in coordination with said first displacement rod, said second displacement rod having a displacement volume that is smaller than a total volume of said second chamber;

said first displacement rod being configured to force a volume of said flowable material that is substantially equal to said first displacement volume through the outlet port of the first chamber when said first displacement rod penetrates into said first chamber;

said second displacement rod being configured to force a volume of said flowable material substantially equal to said second displacement volume through said outlet port of the second chamber when said second displacement rod penetrates into said second chamber; and wherein said first and second displacement rods have geometries that are configured to maintain open space between the first displacement rod and walls of the first chamber and between the second displacement rod and walls of the second chamber, such that flowable material can flow between said displacement rods and said walls from a first end of said displacement rod to a second end of said displacement rod.

2. The dispensing system of claim 1, wherein said first and second displacement rods are free of physical contact with said walls of said first and second chambers, respectively.

3. A dispensing system, comprising:

first and second chambers, each having an inlet port configured to allow flowable material to pass into said chamber and an outlet port configured to allow said flowable material to pass out of said chamber;

a first displacement rod slidably disposed in said first chamber, said first displacement rod having a displacement volume that is smaller than a total volume of said first chamber;

a second displacement rod slidably disposed in the second chamber and configured to operate in coordination with said first displacement rod, said second displacement rod having a displacement volume that is smaller than a total volume of said second chamber;

said first displacement rod being configured to force a volume of said flowable material that is substantially equal to said first displacement volume through the outlet port of the first chamber when said first displacement rod penetrates into said first chamber;

said second displacement rod being configured to force a volume of said flowable material substantially equal to said second displacement volume through said outlet port of the second chamber when said second displacement rod penetrates into said second chamber; and a connecting rod that rigidly connects said first and second displacement rods.

4. The dispensing system of claim 3, wherein the displacement volume of the first displacement rod is larger than the displacement volume of the second displacement rod.

5. The dispensing system of claim 3, further comprising a drive rod rigidly connecting a motor to the first displacement rod to simultaneously actuate the first and second displacement rods.

6. The dispensing system of claim 3, wherein the displacement volume of the first displacement rod is approximately equal to the displacement volume of the second displacement rod.

7. The dispensing system of claim 3, wherein said first and second outlet ports are fluidly connected to a single common system outlet.

8. The dispensing system of claim 7, wherein said dispensing system is configured to cause said flowable material to alternatively flow from said first and second outlet ports to said system outlet so as to deliver a constant flow of said flowable material from said system outlet.

9. The dispensing system of claim 3, wherein the first and second displacement rods and the first and second chambers are cylindrical, and the first and second displacement rods have diameters that are sufficiently less than the diameters of the first and second chambers so as to prevent physical contact between the first and second displacement rods and the first and second chambers, respectively.

10. The dispensing system of claim 3, wherein said connecting rod connects said first and second displacement rods using releasable connectors.

11. The dispensing system of claim 3, further comprising a first interchangeable seal disposed within an aperture of the first chamber and configured to receive the first displacement rod, and a second interchangeable seal disposed within an aperture of the second chamber and configured to receive the second displacement rod.

12. A dispensing system, comprising:

first and second chambers, each having an inlet port configured to allow flowable material to pass into said chamber and an outlet port configured to allow said flowable material to pass out of said chamber;

a first displacement rod slidably disposed in said first chamber, said first displacement rod having a displacement volume that is smaller than a total volume of said first chamber;

a second displacement rod slidably disposed in the second chamber and configured to operate in coordination with said first displacement rod, said second displacement rod having a displacement volume that is smaller than a total volume of said second chamber;

said first displacement rod being configured to force a volume of said flowable material that is substantially equal to said first displacement volume through the outlet port of the first chamber when said first displacement rod penetrates into said first chamber;

said second displacement rod being configured to force a volume of said flowable material substantially equal to said second displacement volume through said outlet port of the second chamber when said second displacement rod penetrates into said second chamber;

first and second pressure sensors configured to measure pressure levels in said first and second chambers, respectively; and a controller communicatively coupled to said pressure sensors, said controller configured to generate signals to control the flow of material in said dispensing system based at least partially on said pressure levels in said first and second chambers.

13. The dispensing system of claim 12, wherein the controller is further configured to perform at least one of the following: independently pre-pressurize each chamber; independently de-pressurize each chamber; monitor pressure in each chamber and compare the monitored pressures to preset limits for high pressure, low dispense pressure, reload pressure, pre-pressure, and de-pressure; and track material pressure during a dispense cycle.

14. A dispensing system, comprising:

first and second chambers, each having an inlet port configured to allow flowable material to pass into said chamber and an outlet port configured to allow said flowable material to pass out of said chamber;

a first displacement rod slidably disposed in said first chamber, said first displacement rod having a displacement volume that is smaller than a total volume of said first chamber;

a second displacement rod slidably disposed in the second chamber and configured to operate in coordination with said first displacement rod, said second displacement rod having a displacement volume that is smaller than a total volume of said second chamber;

said first displacement rod being configured to force a volume of said flowable material that is substantially equal to said first displacement volume through the outlet port of the first chamber when said first displacement rod penetrates into said first chamber;

said second displacement rod being configured to force a volume of said flowable material substantially equal to said second displacement volume through said outlet port of the second chamber when said second displacement rod penetrates into said second chamber; and a first interchangeable seal disposed within an aperture of the first chamber and configured to receive the first displacement rod, and a second interchangeable seal disposed within an aperture of the second chamber and configured to receive the second displacement rod.

* * * * *